US012053025B2

(12) United States Patent
Kudo et al.

(10) Patent No.: US 12,053,025 B2
(45) Date of Patent: Aug. 6, 2024

(54) NON-COMBUSTION HEATING-TYPE SMOKING ARTICLE

(71) Applicant: JAPAN TOBACCO INC., Tokyo (JP)

(72) Inventors: Takahisa Kudo, Tokyo (JP); Nobuyuki Ishikawa, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 1029 days.

(21) Appl. No.: 16/992,586

(22) Filed: Aug. 13, 2020

(65) Prior Publication Data

US 2020/0367560 A1 Nov. 26, 2020

Related U.S. Application Data

(63) Continuation of application No. PCT/JP2018/008255, filed on Mar. 5, 2018.

(51) Int. Cl.
*A24F 40/485* (2020.01)
*A24F 7/00* (2006.01)
(Continued)

(52) U.S. Cl.
CPC ..... *A24F 40/485* (2020.01); *A24F 7/00* (2013.01); *A24F 40/42* (2020.01); *A24F 40/46* (2020.01); *A24F 40/10* (2020.01)

(58) Field of Classification Search
None
See application file for complete search history.

(56) References Cited

U.S. PATENT DOCUMENTS 5,060,671 A * 10/1991 Counts ..... A24F 40/50 131/273
6,155,268 A * 12/2000 Takeuchi ..... A24F 40/485 131/194
(Continued)

FOREIGN PATENT DOCUMENTS

CN 103315404 A 9/2013
CN 105530825 A 4/2016
(Continued)

OTHER PUBLICATIONS

Taiwanese Office Action and Search Report for Taiwanese Application No. 107107689, dated Nov. 30, 2020, with an English translation.
(Continued)

*Primary Examiner* — Travis S Chambers
(74) *Attorney, Agent, or Firm* — Birch, Stewart, Kolasch & Birch, LLP

(57) ABSTRACT

A non-combustion heating-type smoking article comprises: a mouthpiece having a suction port hole; a flavor source accommodation section that accommodates a flavor source, and that has a vapor discharge port that discharges a vapor component generated by evaporation of the flavor source; a heater for heating and evaporating the flavor source; a chamber section for establishing communication between the vapor discharge port and the suction port hole, and temporarily storing the vapor component generated by evaporation of the flavor source; and an air intake hole that establishes communication between the inside and the outside of the chamber section. The vapor discharge port is opened to only the chamber section, and during each suction, the vapor component that has accumulated in the chamber section is mixed with intake air that has flowed into
(Continued)

the chamber section from the air intake hole and is then transported to the suction port hole.

9 Claims, 16 Drawing Sheets

(51) Int. Cl.

| | |
|---|---|
| ***A24F 40/42*** | (2020.01) |
| ***A24F 40/46*** | (2020.01) |
| *A24F 40/10* | (2020.01) |

(56) References Cited

U.S. PATENT DOCUMENTS

| | | | | |
|---|---|---|---|---|
| 2008/0149118 | A1* | 6/2008 | Oglesby | A24F 42/10 131/194 |
| 2015/0020823 | A1 | 1/2015 | Lipowicz et al. | |
| 2016/0106144 | A1* | 4/2016 | Muehlbauer | A24B 15/26 131/352 |
| 2017/0055578 | A1 | 3/2017 | Oda et al. | |
| 2017/0086506 | A1 | 3/2017 | Rado | |
| 2017/0347706 | A1* | 12/2017 | Aoun | A24F 40/42 |
| 2019/0090530 | A1* | 3/2019 | Ishikawa | A24B 15/12 |
| 2020/0205478 | A1 | 7/2020 | Dick et al. | |

FOREIGN PATENT DOCUMENTS

| | | | |
|---|---|---|---|
| CN | 106263031 | A | 1/2017 |
| EP | 0 845 220 | B1 | 9/2003 |
| EP | 3 158 881 | A1 | 4/2017 |
| JP | 2009-502136 | A | 1/2009 |
| JP | 2017-501805 | A | 1/2017 |
| WO | WO 2007/012007 | A2 | 1/2007 |
| WO | WO 2013/120585 | A2 | 8/2013 |
| WO | WO 2015/100361 | A1 | 7/2015 |
| WO | WO 2016/096728 | A1 | 6/2016 |
| WO | WO 2017/108721 | A1 | 6/2017 |
| WO | WO 2017/153270 | A1 | 9/2017 |

OTHER PUBLICATIONS

Chinese Office Action and Search Report dated Dec. 22, 2022 for Application No. 201880090809.4 with an English translation.

International Search Report (PCT/ISA/210) issued in PCT/JP2018/008255 mailed on May 1, 2018.

Extended European Search Report for European Application No. 18908323.1, dated Sep. 24, 2021.

Chinese Office Action for Chinese Application No. 201880090809.4, dated Oct. 13, 2023, with an English translation.

* cited by examiner

FIG. 6

| TEST CONDITION | SPECIFICATIONS OF FLAVOR SOURCE | | | |
|---|---|---|---|---|
| HEATING TEMPERATURE (°C) | SOLUTION | SHREDDED TOBACCO | SOLUTION (mg) : SHREDDED TOBACCO (mg) | PACKED AMOUNT (mg/pod) |
| 200 | PROPYLENE GLYCOL | SHREDDED JAPANESE YELLOW TOBACCO (SIEVE OPENING DIAMETER d < 0.5 mm) | 100:100 | 200 |

COMPARATIVE EXAMPLE 1 HEATED-SECTION VENTILATION STRUCTURE

EXAMPLE 1 HEATED-SECTION NON-VENTILATION STRUCTURE

FIG. 10

| CATEGORY | VENTILATION STRUCTURE | CHAMBER SECTION VOLUME (mL) | OPENING POSITION (mm) | OPENING HEIGHT RATIO (%) | OPENING NUMBER (UNIT) | OPENING DIAMETER (mmϕ) | $R_{pod}$ (%) | SMOKE TEMPERATURE (°C) | DECREASING RATE (–) |
|---|---|---|---|---|---|---|---|---|---|
| EXAMPLE 1 | NON-VENTILATION | 0.4 | 7 | 20 | 2 | 0.5 | 0.15 | 48.2 | 0.66 |
| EXAMPLE 2 | NON-VENTILATION | 2.1 | 3 | 8 | 2 | 0.5 | 21.8 | 51.5 | 0.88 |
| EXAMPLE 3 | NON-VENTILATION | 3.5 | 3 | 7 | 2 | 0.5 | 17.4 | 59.7 | 0.89 |
| EXAMPLE 4 | NON-VENTILATION | 7.9 | 3 | 5 | 2 | 0.5 | 14.6 | 56.8 | 0.71 |
| EXAMPLE 5 | NON-VENTILATION | 2.1 | 13 | 28 | 2 | 0.5 | 0.76 | 57.8 | 0.76 |
| EXAMPLE 6 | NON-VENTILATION | 3.5 | 23 | 54 | 2 | 0.5 | 0.82 | 59.4 | 0.7 |
| EXAMPLE 7 | NON-VENTILATION | 7.9 | 23 | 54 | 2 | 0.5 | 0.39 | 48.7 | 0.71 |
| EXAMPLE 8 | NON-VENTILATION | 7.9 | 43 | 63 | 2 | 0.5 | 0.41 | 50.2 | 0.12 |
| EXAMPLE 9 | NON-VENTILATION | 0.4 | 7 | 20 | 4 | 0.5 | 0.11 | – | – |
| EXAMPLE 10 | NON-VENTILATION | 0.4 | 7 | 20 | 1 | 0.5 | 12.4 | – | – |
| EXAMPLE 11 | NON-VENTILATION | 0.4 | 7 | 20 | 2 | 0.2 | 0.71 | – | – |
| EXAMPLE 12 | NON-VENTILATION | 0.4 | 7 | 20 | 2 | 0.8 | 0.12 | – | – |
| COMPARATIVE EXAMPLE 1 | VENTILATION | 0.4 | – | – | 0 | – | 100 | 102 | 0.91 |

NON-COMBUSTION HEATING-TYPE SMOKING ARTICLE

CROSS-REFERENCE TO RELATED APPLICATIONS

This application is a continuation application of International Application PCT/JP2018/008255 filed on Mar. 5, 2018 and designated the U.S., the entire contents of which are incorporated herein by reference.

TECHNICAL FIELD

The present invention relates to a non-combustion heating-type smoking article.

BACKGROUND ART

There are proposed various non-combustion heating-type smoking articles that heat a flavor source (flavor generating source) with heat generated from an electric heater and that enable suction of a flavor without combustion and thermal decomposition of the flavor source (refer to, for example, Patent document 1, Patent document 2, etc.).

CITATION LIST

Patent Document

Patent document 1: Japanese Unexamined Patent Application Publication (Translation of PCT Application) No. 2009-502136

Patent document 2: Japanese Unexamined Patent Application Publication (Translation of PCT Application) No. 2017-501805

Patent document 3: International Publication No. 2013/120565

SUMMARY OF INVENTION

Technical Problem

Existing non-combustion heating-type smoking articles employ a structure that transports a flavor component into the oral cavity of a smoker by causing inhaled air that has been taken into an inner portion thereof from an air hole of a casing to pass inside a flavor source accommodation section that accommodates a flavor source. A structure (hereinafter referred to as "accommodation-section ventilation structure") in which the flavor source accommodation section is thus ventilated has an advantage that evaporation of the flavor component is accelerated by the inhaled air and the flavor component can be transported easily to a suction port hole of a mouthpiece; meanwhile, there is a possibility that the temperature of smoke supplied into the oral cavity is excessively increased by the inhaled air passing inside the flavor source accommodation section, in which the temperature thereof is caused to be considerably high by heating by a heater. Moreover, there is a concern that, in the aforementioned accommodation-section ventilation structure, acceleration of evaporation of the flavor component when air passes through the flavor accommodation section increases the decreasing speed of the flavor component in the flavor source and causes the amount of smoke and the concentration of the flavor to rapidly decrease in repeated smoking (suction).

The present invention has been made in consideration of the aforementioned circumstances, and an object thereof is to provide a technology related to a non-combustion heating-type smoking article in which the smoke temperature does not rise excessively and the amount of a flavor component that is delivered during each suction is stable.

Solution to Problem

The present invention for solving the aforementioned problem is a non-combustion heating-type smoking article including: a mouthpiece having a suction port hole; a flavor source accommodation section that accommodates a flavor source and that has a vapor discharge port through which a vapor component generated by evaporation of the flavor source is discharged; a heater for heating and evaporating the flavor source; a chamber section for establishing communication between the vapor discharge port and the suction port hole and temporarily storing the vapor component generated by the evaporation of the flavor source; and an air intake hole that establishes communication between an inside and an outside of the chamber section. The vapor discharge port is opened to only the chamber section. The vapor component that has accumulated in the chamber section is mixed during suction with intake air that has flowed into the chamber section from the air intake hole, and the vapor component is transported to the suction port hole. By employing the aforementioned configuration, it is possible to provide a technology related to a non-combustion heating-type smoking article in which the smoke temperature does not rise excessively and the amount of a flavor component that is delivered during each suction is stable. Note that, in the present invention, the chamber section is a hollow space formed between the vapor discharge port and the suction port hole and includes a flow channel formed in the mouthpiece.

In the non-combustion heating-type smoking article according to the present invention, an amount of air that flows into the flavor source accommodation section from the air intake hole through the chamber section may be 25% or less with respect to the total amount of air that flows in from the air intake hole.

In the non-combustion heating-type smoking article according to the present invention, the flavor source may include shredded tobacco and an aerosol-source material.

The non-combustion heating-type smoking article according to the present invention may be configured to include a power source section that supplies power to the heater, the power source section supplying the power to the heater constantly throughout an energization period from when a predetermined energization start condition is established until when a predetermined energization termination condition is established.

In the non-combustion heating-type smoking article according to the present invention, the heater may include a heating element that heats a side surface of the flavor source accommodation section.

In the non-combustion heating-type smoking article according to the present invention, a temperature of the vapor component of the flavor source during smoke suction may be 60° C. or less.

In the non-combustion heating-type smoking article according to the present invention, a capacity of the chamber section may be 2.1 mL or more and 20 mL or less.

In the non-combustion heating-type smoking article according to the present invention, a capacity of the chamber section may be 7.9 mL or more and 20 mL or less, and the ratio (the opening height ratio of the air intake hole) of the length from the vapor discharge port to the air intake hole with respect to the length from the vapor discharge port to the suction port hole may be 63% or more and 90% or less.

In the non-combustion heating-type smoking article according to the present invention, a cooling member for cooling the vapor component of the flavor source may not be disposed in the chamber section.

In the non-combustion heating-type smoking article according to the present invention, the diameter of the air intake hole may be 0.2 mm or more and 0.8 mm or less.

In the non-combustion heating-type smoking article according to the present invention, a plurality of the air intake holes may be disposed in the chamber section.

Advantageous Effects of Invention

According to the present invention, it is possible to provide a technology related to a non-combustion heating-type smoking article in which the smoke temperature does not rise excessively and the amount of a flavor component that is delivered during each suction is stable.

BRIEF DESCRIPTION OF DRAWINGS

FIG. 6 is a list of conditions for a verification test of a smoke-temperature-rise suppressing effect and specifications of a flavor source.

FIG. 10 is a specification list of the examples 1 to 12 and the comparative example 1.

DESCRIPTION OF EMBODIMENTS

Here, an embodiment of the non-combustion heating-type smoking article according to the present invention will be described on the basis of the drawings. The dimensions, the materials, the shapes, the relative arrangements thereof, and the like of constituents described in the present embodiment do not intend to limit the technical scope of the invention thereto only as long as no specific description is provided in particular.

Embodiment 1

Figure 1:
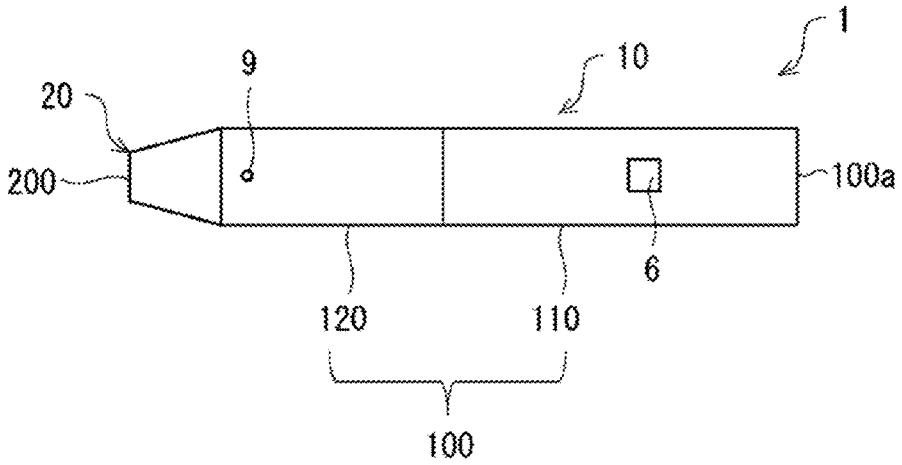
FIG. 1 is a schematic view of a non-combustion heating-type smoking article according to an embodiment 1.
Figure 2A:
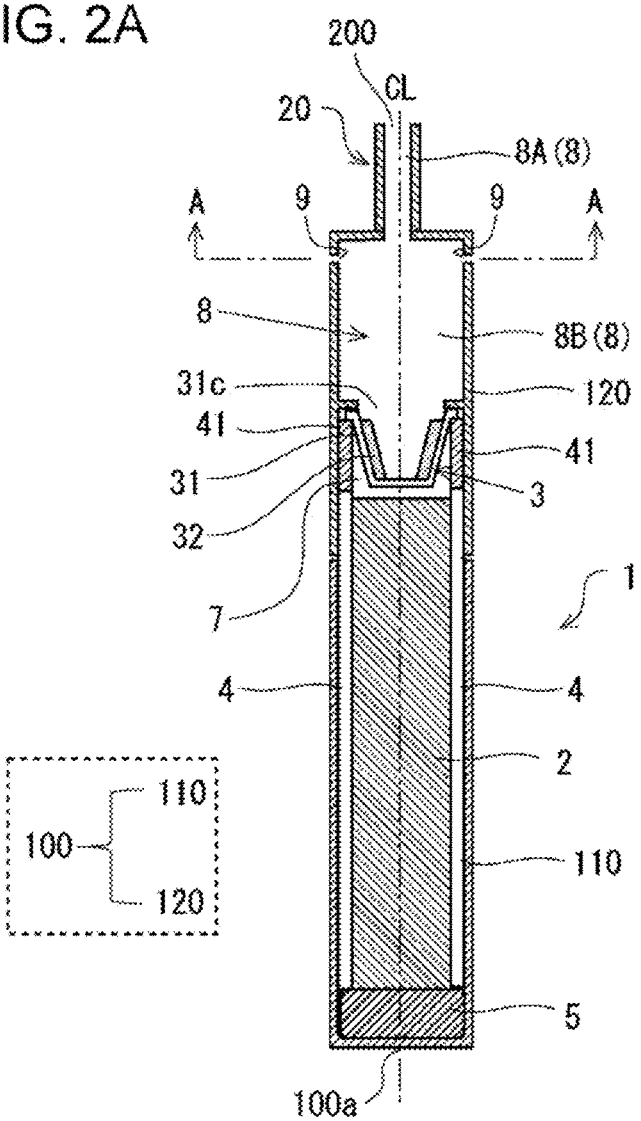
FIG. 2A is a schematic view of the non-combustion heating-type smoking article according to the embodiment 1.
Figure 2B:
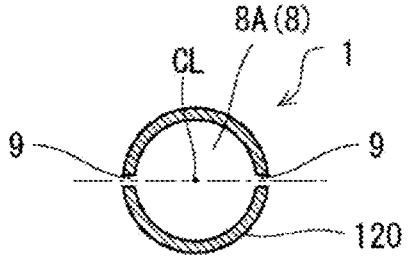
FIG. 2B is a schematic view of the non-combustion heating-type smoking article according to the embodiment 1.

FIG. 1, FIG. 2A, and FIG. 2B are schematic views of a non-combustion heating-type smoking article 1 according to an embodiment 1. FIG. 1 is a side view of the non-combustion heating-type smoking article 1. FIG. 2A illustrates the internal structure of the non-combustion heating-type smoking article 1. FIG. 2B is a sectional view viewed in the direction of arrows A-A in FIG. 2A. The non-combustion heating-type smoking article 1 is a small portable smoking device having a rod shape. The non-combustion heating-type smoking article 1 includes a first casing 110 and a second casing 120 detachable from each other. The first casing 110 is a bottomed cylindrical casing. A mouthpiece 20 is formed on the tip side of the second casing 120. The first casing 110 and the second casing 120 are detachable by a publicly-known connection method, such as a screw method, a snap lock method, or the like. In the present description, the term "casing" denotes a housing that accommodates various parts of the non-combustion heating-type smoking article 1 and may be called, for example, "shell", "housing", and the like. The first casing 110 and the second casing 120 are simply collectively referred to as the casing 100. The sign CL indicated in FIG. 2A and FIG. 2B denotes the center axis of the non-combustion heating-type smoking article 1 (casing 100) extending in the longitudinal axis direction thereof.

Hereinafter, in the non-combustion heating-type smoking article 1, an end where the mouthpiece 20 is disposed is defined as "upper end", and an end opposite thereto is defined as "lower end". The mouthpiece 20 has a suction port hole 200. During smoking, the mouthpiece 20 is held between lips, and smoking is enabled through the suction port hole 200.

The sign 100*a* denotes the rear end of the non-combustion heating-type smoking article 1. The casing 100 accommodates, in the inner portion thereof, a power source section 2, a flavor source accommodation pod 3 (flavor source accommodation section), a heater 4, an electronic control section 5, and the like. The heater 4 is an electric heating-type heater and includes a heating element 41 constituted by, for example, ceramic and the like. The power source section 2 is a battery for supplying electric power to the heater 4 and may be, for example, a rechargeable battery, such as a lithium-ion secondary battery or the like. The electronic control section 5 is a computer for controlling various electronic parts and controls power supply from the power source section 2 with respect to the heater 4. The electronic control section 5 may be a microprocessor including a circuit board (not illustrated) on which, for example, a processor, a memory, and the like are mounted.

The sign 6 indicated in FIG. 1 denotes a power switch. The power switch 6 is, for example, a push-button type switch. The power switch 6 is switchable to be turned on and off by being pressed down. The power switch 6 is connected to the electronic control section 5 via electric wiring, and the turned-on state and the turned-off state of the power switch 6 are detected by the electronic control section 5. Upon detecting that the power switch 6 is operated to be turned on, the electronic control section 5 causes the power source section 2 to start energization of the heater 4. Upon detecting that the power switch 6 is operated to be turned off, the electronic control section 5 causes the power source section 2 to stop energization of the heater 4. When the heater 4 is energized by the power supply from the power source section 2, the heating element 41 generates heat.

Figure 3:
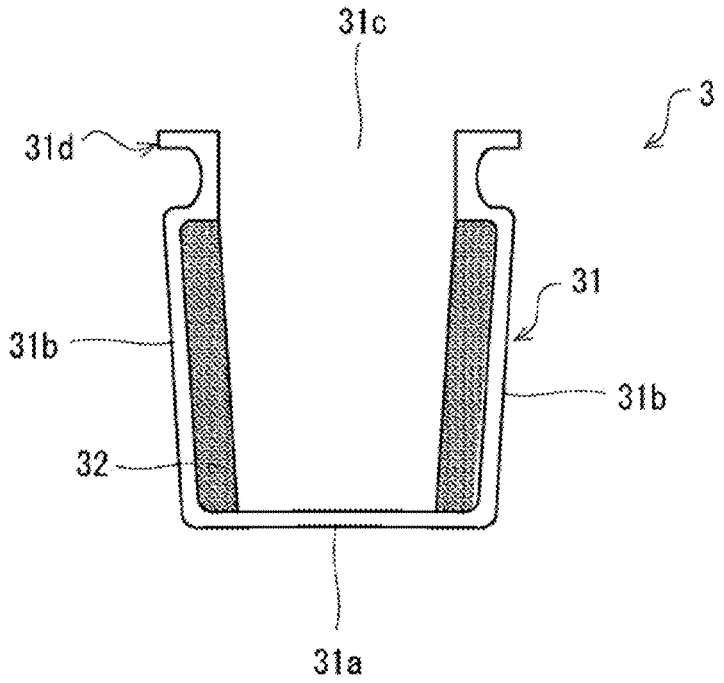
FIG. 3 describes a flavor source accommodation pod according to the embodiment 1.

FIG. 3 describes the flavor source accommodation pod 3 according to the embodiment 1. The flavor source accommodation pod 3 includes a heat-resistant container 31 and a flavor source (flavor generating source) 32 accommodated in the heat-resistant container 31. The heat-resistant container 31 is a metallic container having a cup shape and has a circular flat bottom surface 31*a* and a side surface 31*b* extending upright from the flat bottom surface 31*a*. On the upper end side of the side surface 31*b* of the heat-resistant container 31, a vapor discharge port 31*c* as an open end is formed. The flavor source 32 is not particularly limited provided that the material thereof discharges a flavor by being heated. In the present embodiment, for example, the material includes shredded tobacco, an aerosol-source material, and a flavor that are kneaded and fixed together. In the flavor source accommodation pod 3 in the present embodiment, as illustrated in FIG. 3, the flavor source 32 is accommodated in the heat-resistant container 31 in a state of adhering to the inner side of the side surface 31*b* of the heat-resistant container 31. Note that the accommodated form of the flavor source 32 in the heat-resistant container 31 is not particularly limited. In the present embodiment, the aerosol-source material is a liquid that generates aerosol by being heated and may be, for example, a propylene glycol solution.

As illustrated in FIG. 2A, at the front of the power source section 2 in the casing 100, a hollow section 7 for disposing the flavor source accommodation pod 3 therein is disposed, and the flavor source accommodation pod 3 is disposed in the hollow section 7. The disposing method of the flavor source accommodation pod 3 with respect to the hollow section 7 is not particularly limited. The flavor source accommodation pod 3 is disposed in the hollow section 7 such that the vapor discharge port 31*c* faces the suction port hole 200 of the mouthpiece 20.

As illustrated in FIG. 2A, a chamber section 8 is formed between the vapor discharge port 31*c* of the flavor source accommodation pod 3 and the suction port hole 200 of the mouthpiece 20. The chamber section 8 is a hollow section having a certain capacity. The chamber section 8 is a storage space for establishing communication between the vapor discharge port 31*c* and the suction port hole 200 and temporarily storing a vapor component (flavor component) that is discharged from the vapor discharge port 31*c* during evaporation of the flavor source 32 due to heating by the heating element 41 of the heater 4. In the present embodiment, the vapor discharge port 31*c* of the flavor source accommodation pod 3 is opened to only the chamber section 8. The chamber section 8 in the present embodiment includes a first chamber section 8A and a second chamber section 8B. The first chamber section 8A is a hollow storage space disposed in the mouthpiece 20 and faces the suction port hole 200. The second chamber section 8B is a hollow storage space formed in the upper end side of the second casing 120 and faces the vapor discharge port 31*c*. In the present embodiment, the first chamber section 8A and the second chamber section 8B each have a columnar shape, and the diameter of the second chamber section 8B is larger than the diameter of the first chamber section 8A; however, the shapes thereof are not particularly limited. The ratio between the first chamber section 8A and the second chamber section 8B that constitute the chamber section 8 is not particularly limited. For example, the capacity (volume) of either one of the first chamber section 8A and the second chamber section 8B may be substantially zero. For example, in an example 1, which will be described later, the chamber section 8 is substantially formed by only the first chamber section 8A, and the capacity (volume) of the second chamber section 8B is substantially zero.

As illustrated in FIG. 1, FIG. 2A, and FIG. 2B, the second casing 120 has air intake holes 9 that establish communication between the inside and the outside of the chamber section 8. In the present embodiment, the second casing 120 has two air intake holes 9. The two air intake holes 9 are disposed at heights equal to each other in the longitudinal direction (axial direction) of the non-combustion heating-type smoking article 1. As illustrated in FIG. 2B, the two air intake holes 9 are disposed at positions shifted from each other by 180° in a circumferential direction about the center axis CL of the non-combustion heating-type smoking article 1 and have an arrangement relation of facing each other. In other words, the two air intake holes 9 are disposed at positions that are point-symmetrical to each other about the center axis CL of the non-combustion heating-type smoking article 1.

In the non-combustion heating-type smoking article 1 that is configured as described above, when the electronic control section 5 detects that the power switch 6 is operated to be turned on by a smoker, the electronic control section 5 sends a control signal to the power source section 2 and causes the power source section 2 to start energization of the heater 4. As a result, the heating element 41 generates heat, and the heat-resistant container 31 of the flavor source accommodation pod 3 is heated. Consequently, the flavor source 32 accommodated in the heat-resistant container 31 is heated, and vapor (hereinafter referred to as "flavor vapor") containing a flavor component generated by evaporation of the flavor source 32 is thereby discharged. The flavor vapor generated as a result of the evaporation of the flavor source 32 flows into the chamber section 8 from the vapor discharge port 31*c* of the heat-resistant container 31 of the flavor source accommodation pod 3 and is temporarily stored in the chamber section 8.

When a smoker holds the mouthpiece 20 between the lips in a state in which the flavor vapor is stored, as described above, in the chamber section 8, outside air is taken into the chamber section 8 through the air intake holes 9 that establish communication between the inside and the outside of the chamber section 8. The air that has thus flowed into the chamber section 8 through the air intake holes 9 during suction mixes with the flavor vapor that has accumulated in the chamber section 8 and thereby forms aerosol. The aerosol is transported to the suction port hole 200 of the mouthpiece 20 and supplied into the oral cavity of the smoker through the suction port hole 200.

The non-combustion heating-type smoking article 1 in the present embodiment enables air that has been taken into the chamber section 8 through the air intake holes 9 to be mixed with the flavor vapor stored in the chamber section 8 and to be transported to the suction port hole 200 of the mouthpiece 20 without passing in the heat-resistant container 31 of the flavor source accommodation pod 3, because the non-combustion heating-type smoking article 1 includes the chamber section 8 for establishing communication between the vapor discharge port 31*c* of the flavor source accommodation pod 3 and the suction port hole 200 of the mouthpiece 20 and temporarily storing the flavor vapor generated as a result of the evaporation of the flavor source 32, and the air intake holes 9 that establish communication between the inside and the outside of the chamber section 8, the vapor discharge port 31*c* of the flavor source accommodation pod 3 being configured to be opened to only the chamber section 8. In other words, by employing a structure (hereinafter referred to as "heated-section non-ventilation structure") that does not allow the air (hereinafter also referred to as "intake air") that has flowed into the chamber section 8 through the air intake holes 9 to pass in the heat-resistant container 31 that has been heated to a considerably high temperature by the heating element 41, it is possible to suppress the air that has flowed into the chamber section 8 from the air intake holes 9 from being subjected to a high temperature and to suppress the temperature thereof from excessively rising. Consequently, it is enabled to suppress the temperature of smoke transported into the oral cavity from being excessively high. Note that aerosol and vapor are present by being mixed together in the smoke referred here. Thus, the "smoke" in the present description can be specified as a mixture in which the "aerosol" and the "vapor" are present by being mixed together.

Moreover, by employing the heated-section non-ventilation structure that does not allow the air that has been taken, as described above, into the chamber section 8 from the air intake holes 9 to pass in the heat-resistant container 31, it is possible to suppress evaporation of the flavor source 32 accommodated in the heat-resistant container 31 from being excessively accelerated during heating by the heating element 41 of the heater 4. Consequently, the decreasing speed of the flavor component in the flavor source 32 is prevented from being excessively increased, and it is thus possible to suppress the amount of the smoke and the concentration of the flavor from rapidly decreasing as a result of puffs (suction) being performed by a smoker repeatedly. According to the above, the non-combustion heating-type smoking article 1 in the present embodiment does not cause the temperature of smoke (the temperature of the mixture of aerosol and vapor) to excessively rise and enables the amount of the flavor component delivered during each suction to be stable.

Further, the non-combustion heating-type smoking article 1 in the present embodiment is capable of moderately accelerating the evaporation of the flavor source 32 and sufficiently ensuring the amount of the smoke while employing the non-ventilation structure that does not allow the air that has been taken into the chamber section 8 from the air intake holes 9 to pass in the heat-resistant container 31, because the chamber section 8 has a capacity capable of storing a certain moderate amount of the flavor vapor evaporated from the flavor source 32 accommodated in the heat-resistant container 31.

In the present embodiment, during energization of the heater 4 by the power source section 2, the electronic control section 5 controls the power source section 2 such that the temperature of the heat-resistant container 31 (or the ambient temperature in the heat-resistant container 31) is in the range of 150° C. to 250° C. For example, the electronic control section 5 is capable of controlling, by publicly-known temperature feedback control, the energization of the heater 4 by the power source section 2 such that the temperature of the heat-resistant container 31 (or the ambient temperature in the heat-resistant container 31) is maintained in the range of 150° C. to 250° C. In that case, the temperature of the side surface 31*b* of the heat-resistant container 31 or the ambient temperature in the heat-resistant container 31 may be monitored by using a temperature sensor. By maintaining the temperature of the heat-resistant container 31 or the ambient temperature in the heat-resistant container 31 to be within the aforementioned proper range, it is possible to properly atomize the flavor source 32 while suppressing the flavor source 32 (shredded tobacco) from burning.

In the non-combustion heating-type smoking article 1 in the present embodiment, the chamber section 8 has the two air intake holes 9, and the two air intake holes 9 are disposed at positions that are point-symmetrical to each other about the center axis CL of the non-combustion heating-type smoking article 1, that is, at positions shifted from each other by 180° in the circumferential direction. By disposing a pair of the air intake holes 9 at the positions symmetrical about the center axis CL, collision of the intake air occurs at the center of the cross-section of the chamber section 8, and the linear velocity of the intake air that flows downward (in the direction of the flavor source accommodation pod 3) due to the collision can be reduced, compared with when the number of the air intake holes is one. As a result, it is possible to reduce the air inflow ratio, which is a ratio of the amount of air that enters the flavor source accommodation pod 3 through the chamber section 8 with respect to the total air amount of the intake air that flows into the chamber section 8 from the air intake holes 9.

Preferably, the non-combustion heating-type smoking article 1 in the present embodiment has a large number of the air intake holes 9. Under a condition in which the amount of suction by a smoker is assumed to be constant, as the number of the air intake holes 9 increases, the amount of the air that flows into the chamber section 8 from each air intake hole 9 decreases, and thus, the linear velocity of the intake air that flows into the chamber section 8 from the air intake holes 9 decreases. As a result, the intake air that flows into the chamber section 8 from the air intake holes 9 is enabled not to easily enter the flavor source accommodation pod 3. Consequently, it is possible to more suitably provide the non-combustion heating-type smoking article 1 in which the smoke temperature does not rise excessively and the amount of the flavor component that is delivered during each suction is stable.

In the non-combustion heating-type smoking article 1, in response to the power switch 6 being operated to be turned on by a smoker, the electronic control section 5 sends a control signal to the power source section 2 and causes the power source section 2 to start energization of the heater 4, and, in response to the power switch 6 being operated to be turned off, the electronic control section 5 sends a control signal to the power source section 2 and causes the power source section 2 to terminate the energization of the heater 4. In the aforementioned case, an energization start condition is established when the power switch 6 is operated to be turned on, and an energization termination condition is established when the power switch 6 is operated to be turned off. Power supply from the power source section 2 to the heater 4 is configured to be continued constantly throughout an energization period from when the energization start condition is established until the energization termination condition is established. In such a constant heating-type non-combustion heating-type smoking article 1, atomization of the flavor source 32 constantly occurs in the flavor source accommodation pod 3 during the energization period. Therefore, it is useful, in particular, to suck the flavor vapor stored temporarily in the chamber section 8 after the flavor vapor generated in the flavor source accommodation pod 3 has flowed into the chamber section 8.

The non-combustion heating-type smoking article 1 in the present embodiment employs a structure in which the heater 4 includes the heating element 41 that heats the side surface of the flavor source accommodation pod 3 and in which the heater 4 is not disposed in the chamber section 8. The non-combustion heating-type smoking article 1 in the present embodiment thus has an advantage that it is possible to cool aerosol, which is flavor suction air, accumulated in the chamber section 8. Moreover, in the non-combustion heating-type smoking article 1, the chamber section 8 includes no particular cooling member for cooling the vapor component of the flavor source 32. By employing the aforementioned heated-section non-ventilation structure, the non-combustion heating-type smoking article 1 is capable of suppressing the temperature of the flavor vapor from becoming excessively high, which eliminates the need to provide a cooling member in the chamber section 8 and enables the smoking device to be manufactured at reduced costs.

Hereinafter, various effects realized by the non-combustion heating-type smoking article 1 according to the present embodiment will be verified.

<Verification of Smoke-Temperature-Rise Suppressing Effect>

To verify a smoke-temperature-rise suppressing effect exerted by employing the heated-section non-ventilation structure that does not allow intake air to pass in the heat-resistant container 31, the temperature of smoke during inhalation was compared between the non-combustion heating-type smoking article 1 according to the present embodiment and a comparative example 1 that employs a heated-section ventilation structure that allows intake air to pass in the heat-resistant container 31.

Figure 4A:
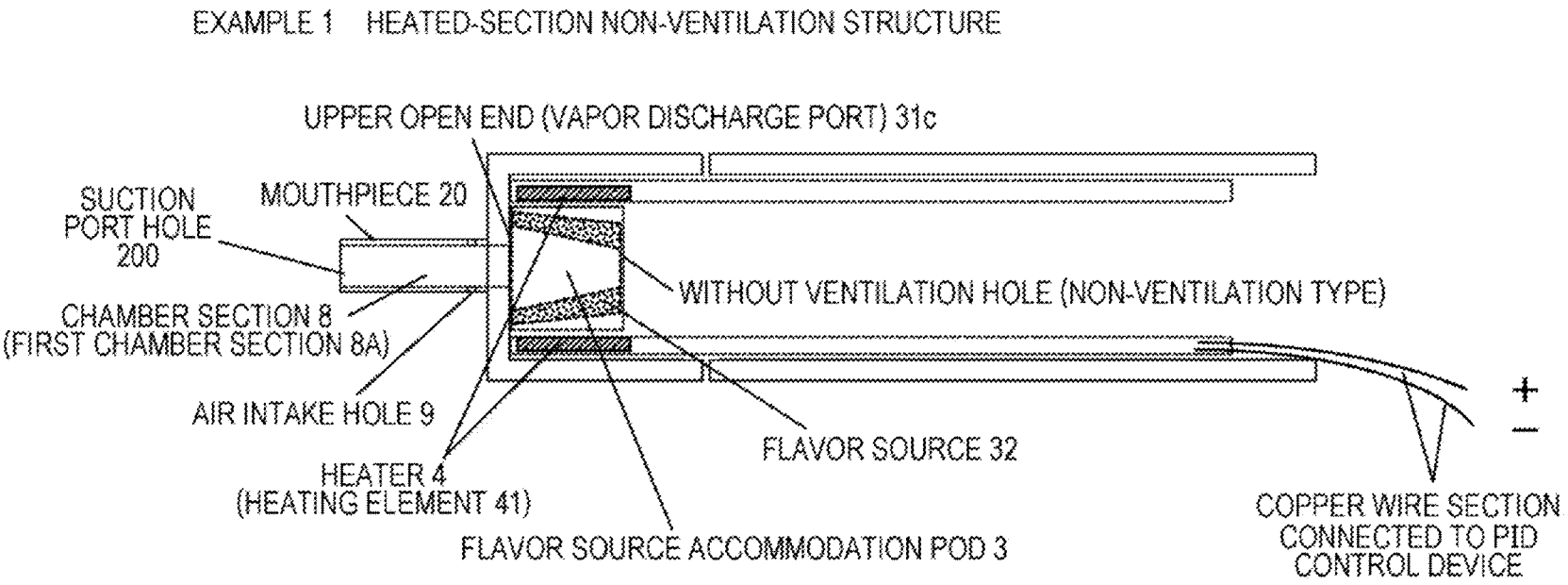
FIG. 4A illustrates a general structure of a device according to an example 1.
Figure 4B:
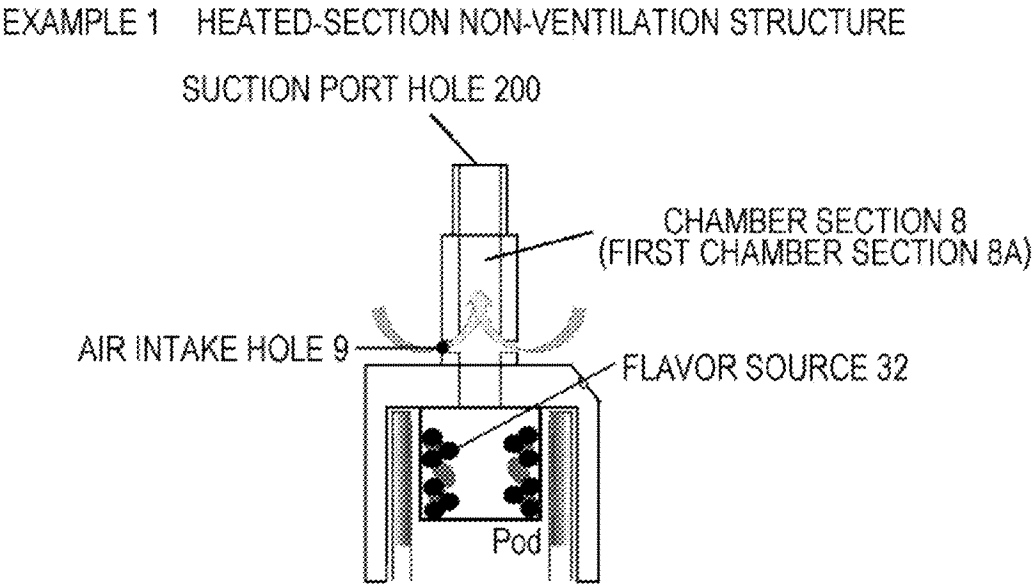
FIG. 4B conceptually illustrates the flow of intake air in the device according to the example 1.
Figure 5A:
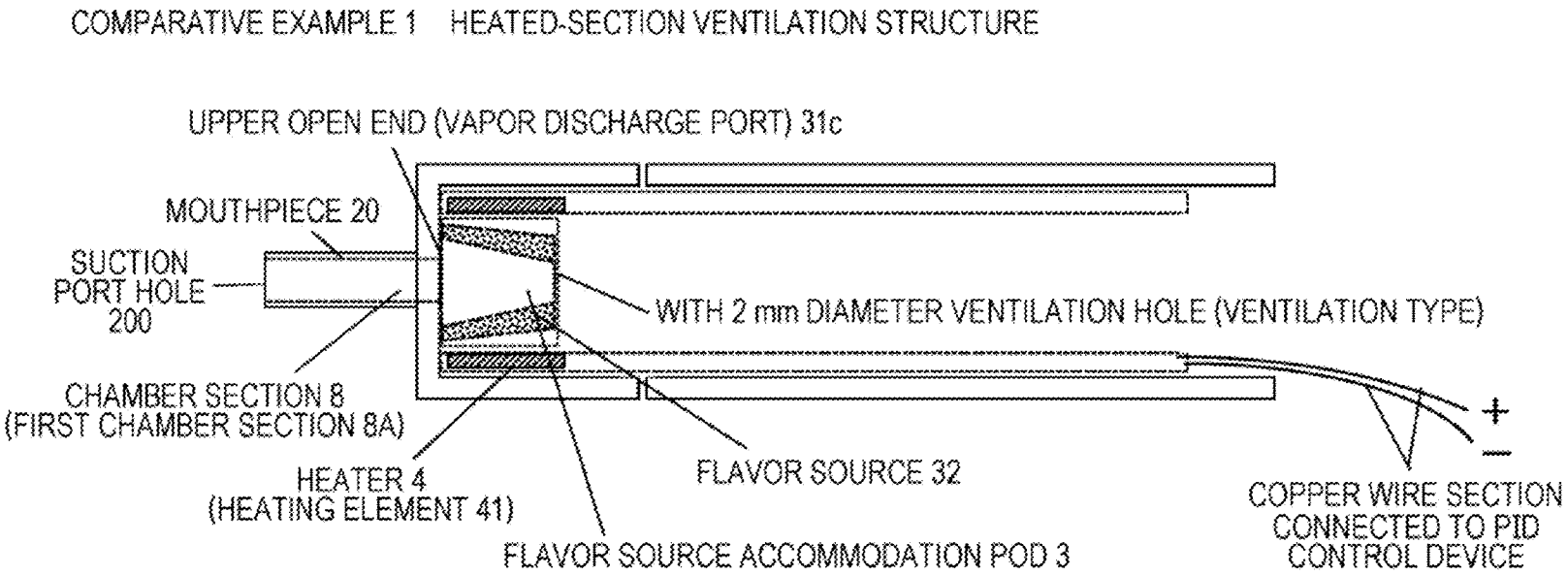
FIG. 5A illustrates a general structure of a device according to a comparative example 1.
Figure 5B:
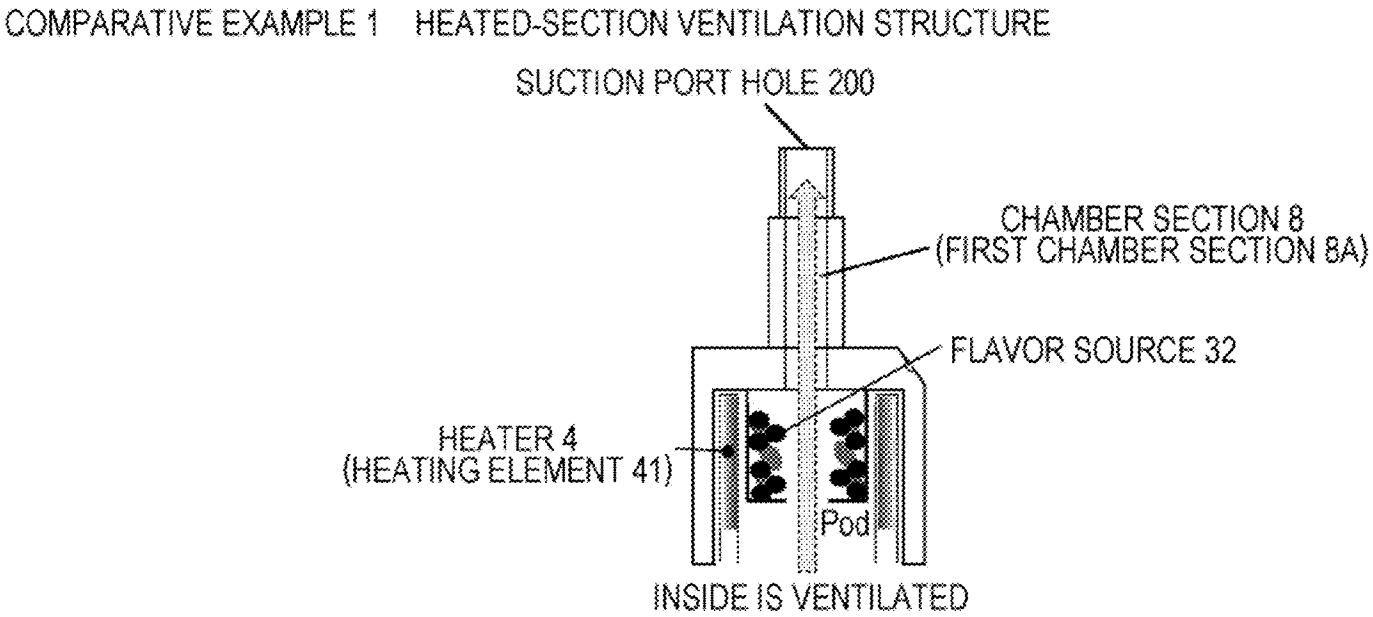
FIG. 5B conceptually illustrates the flow of intake air in the device according to the comparative example 1.

FIG. 4A illustrates a general structure of a device according to the example 1. FIG. 4B conceptually illustrates the flow of intake air in the device according to the example 1. FIG. 5A illustrates a general structure of a device according to the comparative example 1. FIG. 5B conceptually illustrates the flow of intake air in the device according to the comparative example 1.

The example 1 illustrated in FIG. 4A and FIG. 4B is a heated-section non-ventilation type device simulating the non-combustion heating-type smoking article 1 according to the present embodiment and uses the flavor source accommodation pod 3 having a bottom surface without a ventilation hole. The mouthpiece 20 has the air intake holes 9 disposed in two locations. Each air intake hole 9 has a hole diameter of 0.5 mmφ and is disposed at a height of 7 mm from the upper open end (vapor discharge port) 31*c* of the flavor source accommodation pod 3. In the example 1, a ratio (hereinafter referred to as "the opening height ratio of the air intake holes") of the length from the vapor discharge port 31*c* to the air intake holes 9 with respect to the length from the vapor discharge port 31*c* to the suction port hole 200 (the upper end of the first chamber section 8A) is 20%. In the example 1, the capacity (volume) of the chamber section 8 (first chamber section BA) in a flow channel from the upper open end (vapor discharge port) 31*c* of the flavor source accommodation pod 3 to the air intake holes 9 is set to 0.4 mL. In the example 1, the chamber section 8 is substantially constituted by only the first chamber section 8A (the inner space of the mouthpiece 20), and the capacity (volume) of the second chamber section 8B is substantially zero. In contrast, the comparative example 1 illustrated in FIG. 5A and FIG. 5B is formed as a heated-section ventilation type device in which a ventilation hole having a diameter of 2 mm is formed in a bottom portion of the flavor source accommodation pod 3 and differs from the example 1 in that the mouthpiece 20 does not have the air intake holes 9. The capacity of a hollow portion obtained by deducting a volume occupied by the flavor source (a mixture of shredded tobacco and an aerosol-source material) 32 from the capacity of the flavor source accommodation pod 3 is 0.3 mL in both the example 1 and the comparative example 1.

FIG. 6 is a list of conditions for a verification test of the smoke-temperature-rise suppressing effect and specifications of the flavor source. A smoking test was performed for each of the devices of the example 1 and the comparative example 1 by using a smoking machine (Borgwaldt, RM-26). The flow rate of sucked smoke in the smoking test was set to 55 mL/2 seconds, and the smoking interval was set to 30 seconds. In temperature control of each device during the smoking test, a desktop temperature control unit (manufactured by CHINO Cooperation, type: SY2111-30) and a type K thermocouple were used. The type K thermocouple was set to be in contact with the surface of the flavor source (shredded tobacco) 32 in the flavor source accommodation pod 3. A temperature rise profile was set such that the temperature of the heater reaches a target temperature range (200° C.) after a lapse of 120 seconds. After the target temperature range was reached, PID control was performed by measuring the temperature of the flavor source (shredded tobacco) 32 in real time.

Figure 7:
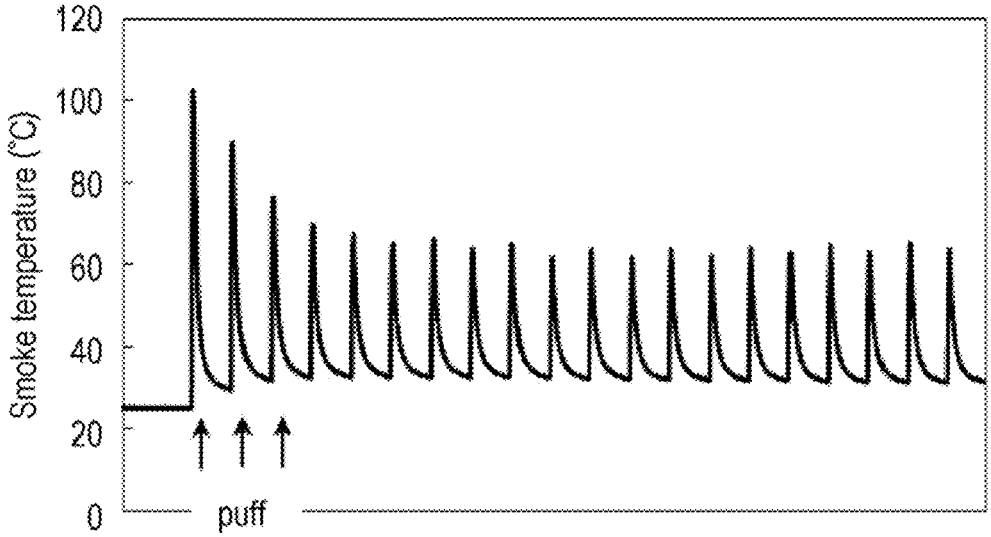
FIG. 7 is a graph showing a measurement result of smoke-temperature history of the comparative example 1.
Figure 8:
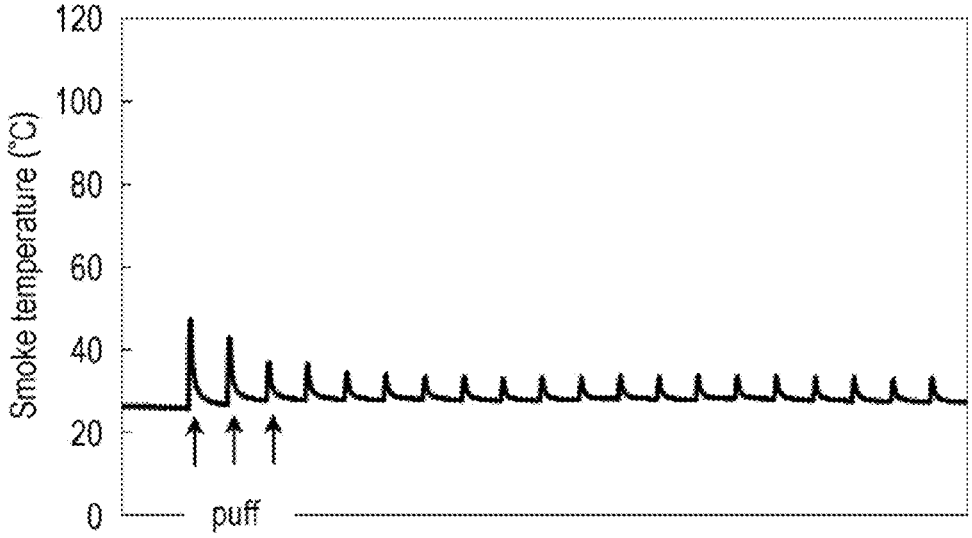
FIG. 8 is a graph showing a measurement result of the smoke-temperature history of the example 1.

For the smoking test, a silicone tube was connected to each of the devices of the example 1 and the comparative example 1, and the thermocouple was inserted into the mouthpiece 20 at a position away from the tip thereof by 30 mm. The temperature of smoke (a mixture containing aerosol and vapor) sucked by the smoking machine was measured by measuring temperature history. FIG. 7 is a graph showing a measurement result of the history of the smoke temperature of the comparative example 1. FIG. 8 is a graph showing a measurement result of the history of the smoke temperature of the example 1. In the comparative example 1 employing the heated-section ventilation structure, the smoke temperature reached 100° C. at the first puff and became constant at approximately 60° C. at the fifth puff or later. In contrast, in the example 1 employing the heated-section non-ventilation structure, the highest temperature at the first puff was 50° C. or less, and approximately 30° C. was stably maintained at the fifth puff or later. According to the above, it was confirmed that, compared with the comparative example 1 employing the heated-section ventilation structure, the example 1 employing the heated-section non-ventilation structure was able to further suppress the rise of the smoke temperature. In addition, it was confirmed that the example 1 enabled the smoke temperature during smoking to be maintained in a temperature range in the vicinity of room temperature without separately providing a smoke cooling mechanism for cooling the smoke.

<Evaluation of Flavor Component Delivery Tendency>

Figure 9:
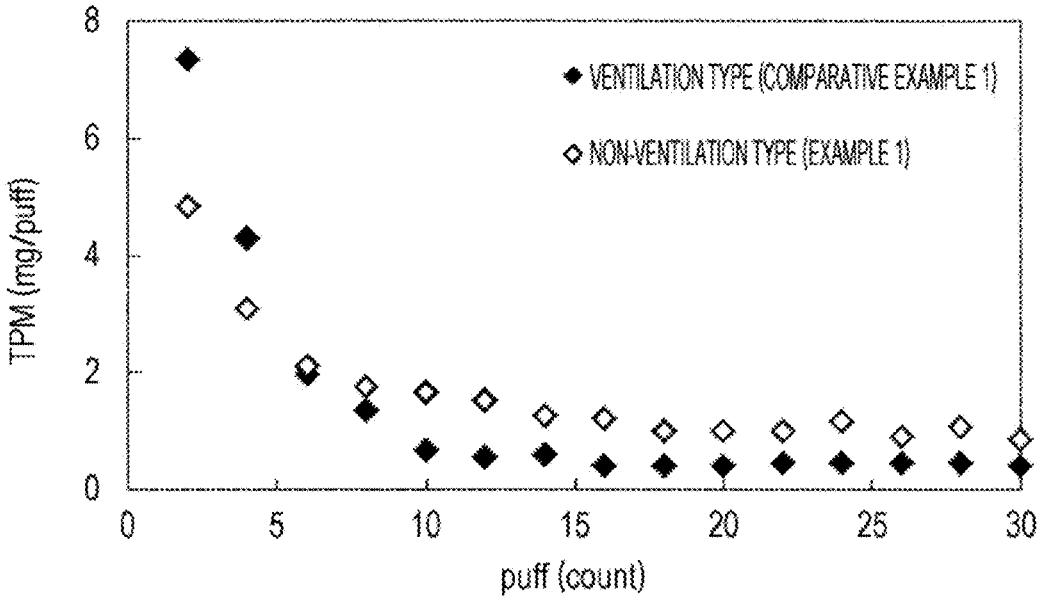
FIG. 9 is a graph showing the amount of a total particulate matter contained in aerosol and vapor sucked by a smoking machine in smoking tests for the example 1 and the comparative example 1.

During execution of the aforementioned smoking test, the amount of total particulate matter (TPM: total particulate matter) contained in the aerosol and the vapor sucked by the smoking machine was measured for each of the example 1 and the comparative example 1. FIG. 9 is a graph showing the amount of the total particulate matter contained in the aerosol and the vapor sucked by the smoking machine during the smoking test for the example 1 and the comparative example 1. The vertical axis indicates the amount of the total particulate matter (TPM), and the horizontal axis indicates the number of times of puffs.

The measurement of the amount of the total particulate matter was performed by using the smoking machine. Under predetermined smoking conditions (a smoke suctioning capacity of 55 mL/2 seconds and a smoking interval of 30 seconds), smoke of 30 puffs was caught by a Cambridge filter (CF) at intervals of 2 puffs, and a weight increase amount of aerosol-formed substances adhering to the Cambridge filter was weighted to thereby determine the amount of the total particulate matter. Regarding the puffs in the initial state (up to approximately 10 puffs), the amount of the total particulate matter tended to be relatively larger in the comparative example 1 employing the heat-section ventilation structure than in the example 1 employing the heated-section non-ventilation structure. The tendency was reversed at the tenth puff or later, and it was confirmed that the amount of the total particulate matter tended to be larger in the example 1 than in the comparative example 1.

Regarding the comparative example 1 employing the heated-section ventilation structure, in particular, in the initial stage of smoking in which an aerosol solution is plentifully present, evaporation of the flavor component is accelerated because intake air passes on the surface of the flavor source heated by the heater 4 during 2 seconds of suction by the smoking machine. In contrast, in the example 1 that employs the heated-section non-ventilation structure, the intake air does not pass on the surface of the flavor source 32 heated by the heater 4, and it is thus considered that vapor that has accumulated in the chamber section is dominantly sucked during suction by the smoking machine. As a result, evaporation from the flavor source 32 is not excessively accelerated to a degree of excessive acceleration in the comparative example 1 that employs the heated-section ventilation structure, and the decreasing speed of the flavor component of the flavor source 32 is moderately reduced. In other words, compared with the comparative example 1 employing the heated-section ventilation structure, the flavor component can be stably delivered in the example 1 employing the heated-section non-ventilation structure.

Here, when the decreasing rate (hereinafter referred to as "TPM decreasing rate") of the amount of the total particulate matter (TPM) contained in the aerosol and the vapor during smoking is defined by the following formula, the TPM decreasing rate in the comparative example 1 employing the heated-section ventilation structure was 0.91 while the TPM decreasing rate in the example 1 employing the heated-section non-ventilation structure was 0.61. Here, the fact that the TPM decreasing rate is small indicates that a decrease in the component delivery amount during the first puff to the tenth puff is small (stable). As described above, the TPM decreasing rate is smaller in the heated-section non-ventilation structure (example 1) than in the heated-section ventilation structure (comparative example 1). It is thus considered that the component can be more stably delivered in the heated-section non-ventilation structure (example 1).

TPM decreasing rate (–)=1–TPM amount (mg/puff) in tenth puff/TPM amount (mg/puff) in first puff Next, examples 2 to 12 in which the capacity (volume) of the chamber section 8, the opening position, the opening number, and the opening diameter of the air intake holes 9, and the like have been changed from those in the example 1 will be described. FIG. 10 is a specification list of the examples 1 to 12 and the comparative example 1. FIG. 10 also indicates an air inflow ratio Rpod related to the examples 1 to 12 and the comparative example 1, and the smoke temperature and the TPM decreasing rate related to the examples 1 to 8 and the comparative example 1. Details of the air inflow ratio Rpod will be described later. The "opening position (mm)" in FIG. 10 is a separated dimension between the upper open end (vapor discharge port) 31*c* of the flavor source accommodation pod 3 and the air intake holes 9. The "opening height ratio (%)" in FIG. 10 denotes "the opening height ratio of the air intake holes" and, as described above, is the ratio of the length from the vapor discharge port 31*c* to the air intake holes 9 with respect to the length from the vapor discharge port 31*c* to the suction port hole 200 (the upper end of the first chamber section 8A). Regarding the examples 1 to 8, 11, and 12, two air intake holes 9 are disposed to face each other at positions shifted from each other by 180° in the circumferential direction about the center axis of respective device. Regarding the example 9, four air intake holes 9 are disposed at positions shifted from each other by 90° in the circumferential direction about the center axis of the device.

Figure 11:
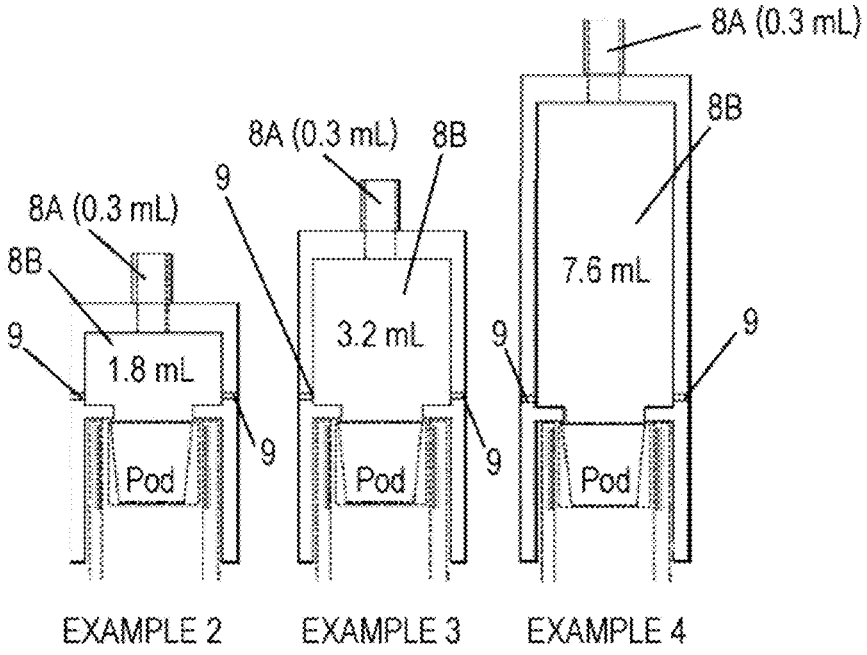
FIG. 11 illustrates general structures of devices according to the examples 2 to 4.

Here, the examples 2 to 12 each employ the heated-section non-ventilation structure, as with the example 1. In the examples 2 to 4, the capacity of the chamber section 8 has been changed, as a parameter, from the example 1. FIG. 11 illustrates a general structure of each of devices according to the examples 2 to 4. In contrast to the capacity (the total of the capacities of the first chamber section 8A and the second chamber section) of the chamber section 8 in the example 1 being 0.4 mL, the capacity (the total of capacities of the first chamber section 8A and the second chamber section) of the chamber section 8 in the examples 2, 3, and 4 are 2.1 mL, 3.5 mL, and 7.9 mL, respectively. The flavor source accommodation pod 3 in each of the examples 2 to 4 is identical to the flavor source accommodation pod 3 in the example 1 described in FIG. 4A.

Figure 12:
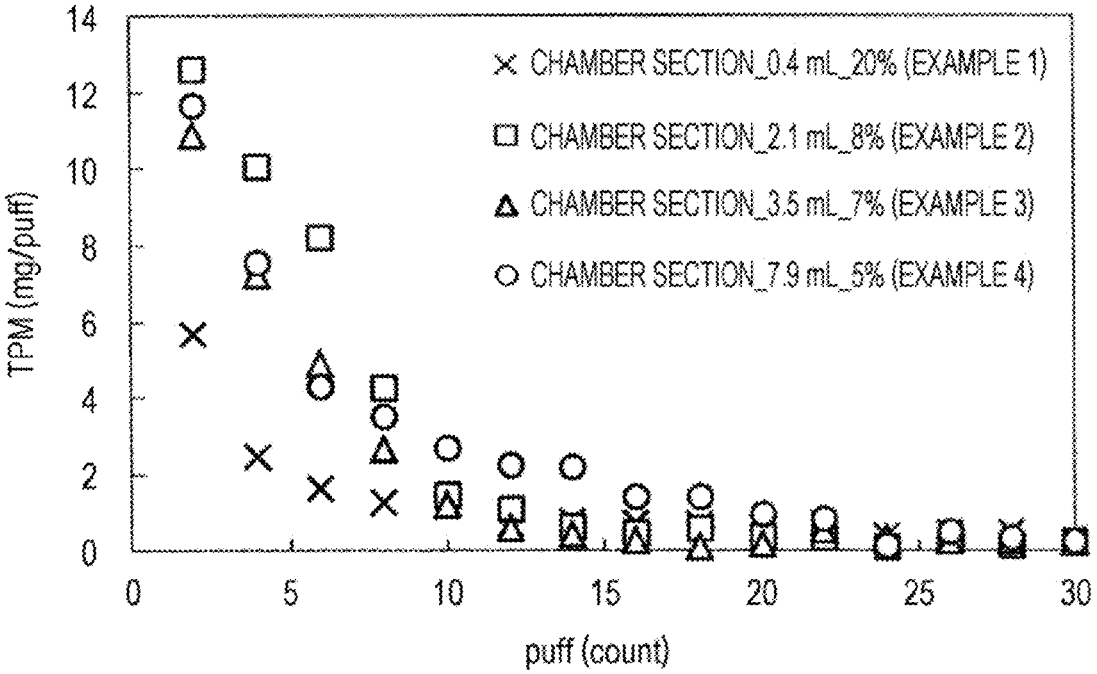
FIG. 12 is a graph showing a result of measurement of the TPM amount when smoking tests were performed for the examples 1 to 4.

FIG. 12 is a graph showing a result of measurement of the amount of the total particulate matter (TPM) when smoking tests were performed for the examples 1 to 4. FIG. 12 shows that, in the examples 2 to 4 in each of which the capacity of the chamber section is increased compared with the example 1, the amount of the total particulate matter (TPM) contained in the aerosol and the vapor is increased more than in the example 1. This is considered to be because, due to the capacity of the chamber section 8 being sufficiently ensured and thereby causing the partial pressure of the vapor in the chamber section 8 not to increase excessively during the smoking interval of 30 seconds, it is possible to suppress the evaporation of the flavor component of the flavor source 32 accommodated in the flavor source accommodation pod 3 from being impeded. In other words, it was found that it is possible by sufficiently ensuring the capacity of the chamber section 8 as with the examples 2 to 4 to suppress, even when evaporation of the flavor component has proceeded, the partial pressure of the vapor in the chamber section 8 from becoming excessively high and that it is possible to increase the delivery amount of the flavor component by smoothly accelerating the evaporation of the flavor component from the flavor source 32 accommodated in the flavor source accommodation pod 3. Regarding the delivery amount of the flavor component during the smoking tests, no significant difference was found among the examples 2 to 4. Therefore, it can be said that, by disposing the chamber section 8 having a certain capacity (for example, the capacity of the chamber section 8 is 2.1 mL) or more on an upper portion of the flavor source accommodation pod 3, it is possible, regardless of the capacity of the chamber section 8, to sufficiently ensure the delivery amount of the flavor component. The chamber section 8 having an excessively large size is, however, not realistic as a small smoking device in consideration of the specifications of the smoking device. The capacity of the chamber section 8 is thus preferably 20 mL or less.

Figure 13:
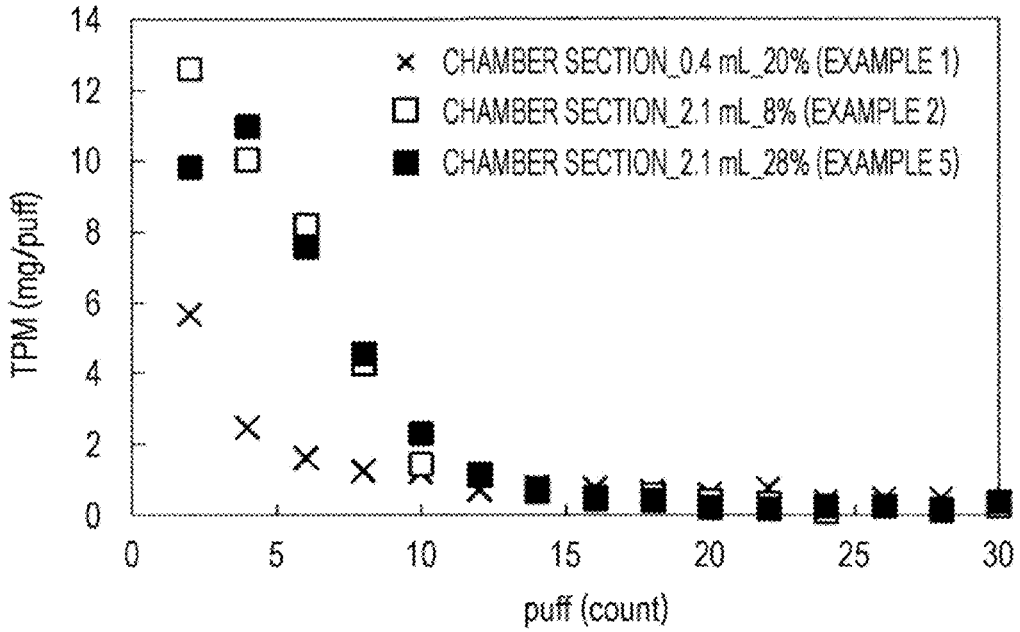
FIG. 13 is a graph showing a result of measurement of the TPM amount when smoking tests were performed for the examples 1, 2, and 5.
Figure 14:
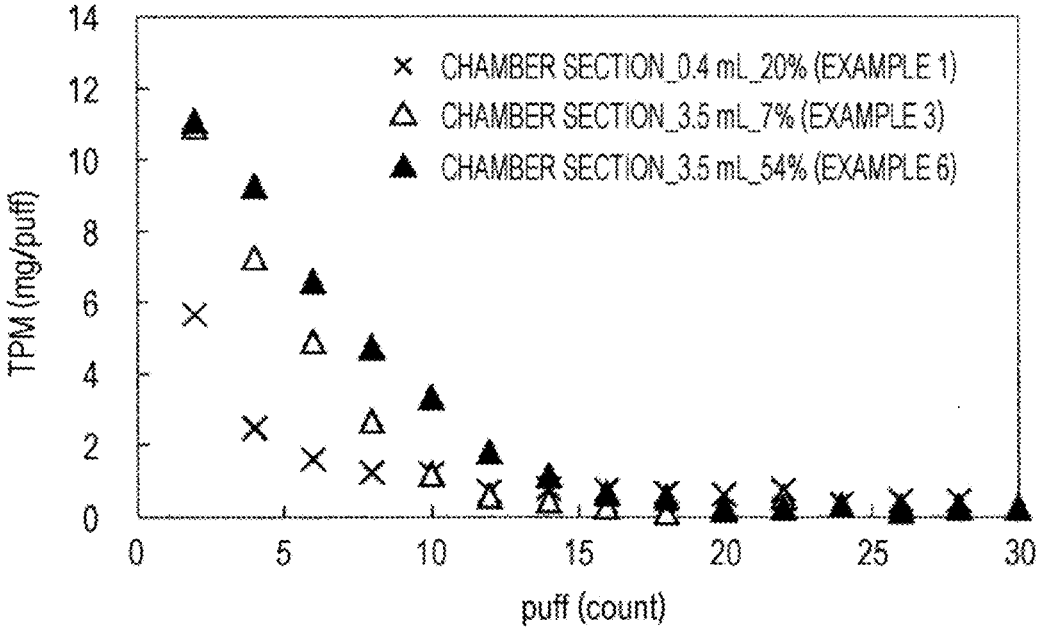
FIG. 14 is a graph showing a result of measurement of the TPM amount when smoking tests were performed for the example 1, 3, and 6.
Figure 15:
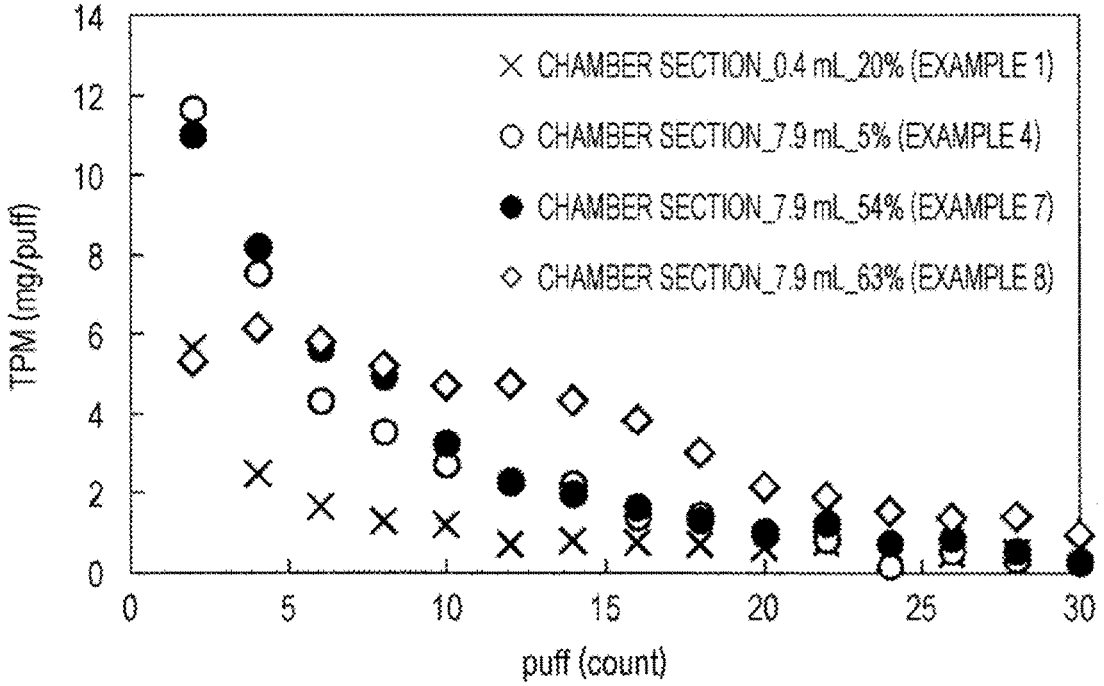
FIG. 15 is a graph showing a result of measurement of the TPM amount when smoking tests were performed for the examples 1, 4, 7, and 8.

Next, influences when the opening position, the opening number, and the opening diameter of the air intake holes 9 have been changed as parameters will be described. FIG. 13 is a graph showing a result of measurement of the amount of the total particulate matter (TPM) when smoking tests were performed for the examples 1, 2, and 5. FIG. 14 is a graph showing a result of measurement of the amount of the total particulate matter (TPM) when smoking tests were performed for the examples 1, 3, and 6. FIG. 15 is a graph showing a result of the measurement of the amount of the total particulate matter (TPM) when smoking tests were performed for the examples 1, 4, 7, and 8.

As shown in FIG. 15, a sufficient amount of the component delivery amount was generally maintained up to the fifteenth puff in the example 8 in which the capacity of the chamber section 8 is 7.9 mL and in which the opening position of the air intake holes 9 is 43 mm (corresponding to a position at which the "opening height ratio of the air intake holes" is 63%). This is considered to be caused by the sucked amount of the vapor of the flavor component that has accumulated in the chamber section 8 being suppressed by the positions of the air intake holes 9 being far from the flavor source accommodation pod 3. Accordingly, setting the capacity of the chamber section 8 to 7.9 mL or more and disposing the air intake holes 9 at positions at which the opening height ratio of the air intake holes 9 is 63% or more are considered to be preferable to increase the evaporation amount of the flavor component more than the structure in which the chamber section 8 is not disposed and to stabilize the component delivery amount.

<Fluid Analysis>

Next, the air inflow ratio Rpod of air that flows into the flavor source accommodation pod 3 will be compared between each example and the comparative example 1. The air inflow ratio Rpod is a ratio of the amount of air that enters the flavor source accommodation pod 3 through the chamber section 8 with respect to the total air amount of intake air that flows into the chamber section from the air intake holes 9 during 2 seconds of smoke suction by the smoking machine. The air inflow ratio Rpod was calculated by fluid analysis. The fluid analysis was performed under initial conditions in which, as temperature conditions in calculation of the air inflow ratio Rpod, 500 Kelvin was set for the wall surface of the flavor source accommodation pod 3 (heat-resistant container 31) and a space portion inside the pod, and 300 Kelvin was set for other spaces. The fluid analysis was performed by using Fluent version 18.0 (ANSYS) under a sign profile of a smoke-suction flow rate of 55 mL/2 seconds. The air inflow ratio Rpod (%) of air that flows into the flavor source accommodation pod 3 was calculated by using the following formula.

$$R_{pod}(\%) = \frac{V_{pod}\ (\text{mL})}{2V_{inhalation}\ (\text{mL})} \times 100$$

Here, Vpod denotes the volume of air that has entered the inner portion of the flavor source accommodation pod 3 during 2 seconds of smoke suction by the smoking machine. Vinhalation denotes a smoke suctioning capacity and is set to a constant value of 55 mL. In this fluid analysis, the air that enters (flows into) the flavor source accommodation pod 3 and the air that flows out from the flavor source accommodation pod 3 were counted at the same time, and, from the value thereof, the volume of the air that enters the flavor source accommodation pod 3 was calculated. An actual value was thus multiplied by 0.5 in the calculation of the air inflow ratio Rpod. The analysis result is as shown in FIG. 10. The air inflow ratio Rpod in the example 1 was 0.15%, and it was confirmed that almost no air entered the flavor source accommodation pod 3.

Figure 16:
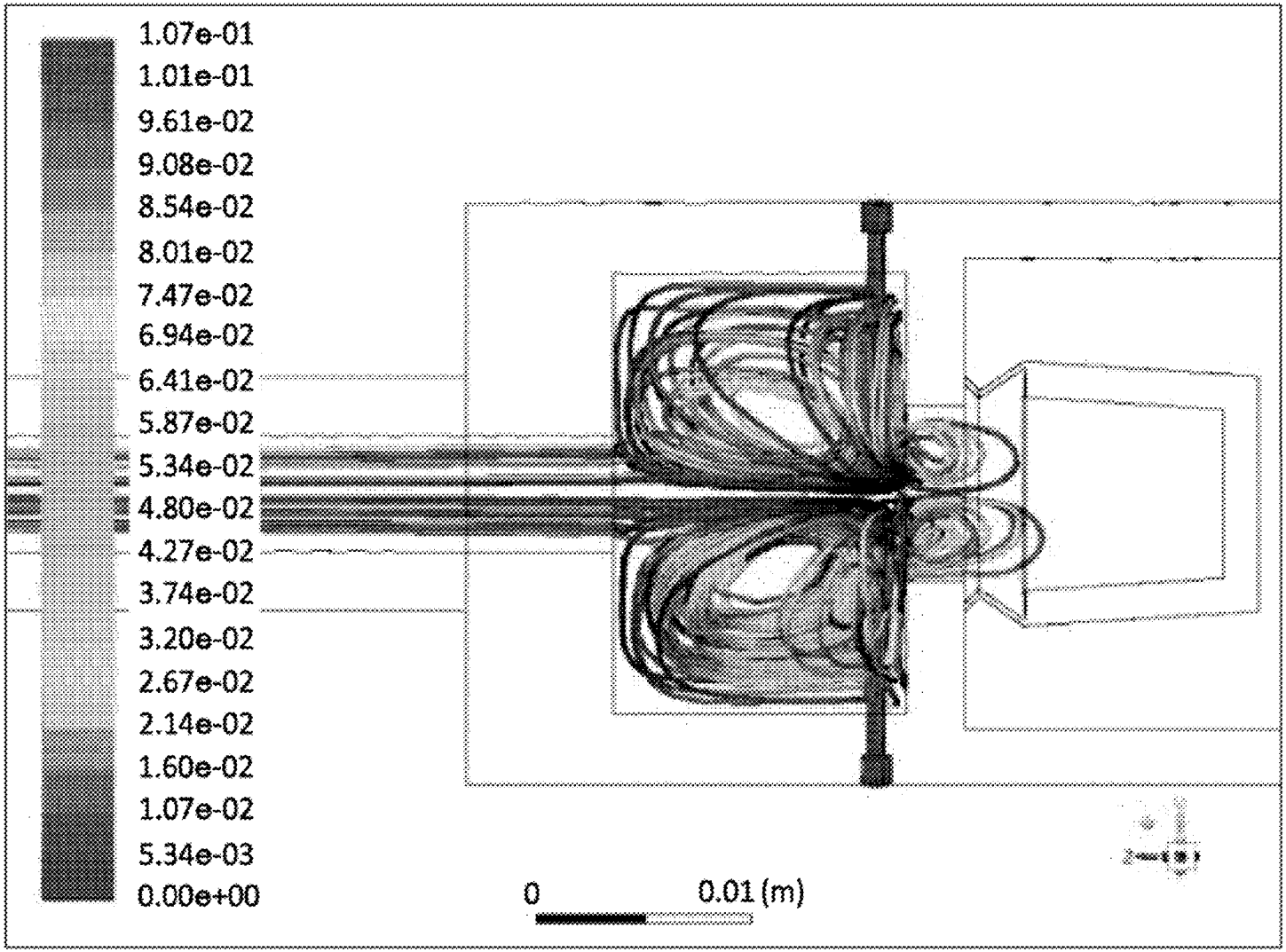
FIG. 16 illustrates a fluid pass line of intake air in a device according to the example 2.

As indicated in FIG. 10, the air inflow ratio Rpod in the examples 2 to 4 is higher by 10% or more compared with the other examples. This is considered to be due to the intake air being caused to enter the flavor source accommodation pod 3 by a downward air flow that is generated by the collision, which has occurred in the chamber section 8, of the intake air that has flowed in from the two air intake holes 9 disposed at mutually facing positions in the chamber section 8. As an example, FIG. 16 illustrates a fluid pass line of intake air in the device according to the example 2.

In the examples 5 to 8 in each of which the opening position of the air intake holes 9 is far from the flavor source accommodation pod 3, the downward air flow generated by the collision of the intake air in a center portion of the chamber section 8 did not reach the flavor source accommodation pod 3, and a result in which the air inflow ratio Rpod was 1% or less was obtained. Regarding the opening number of the air intake holes 9, tendency similar to that in the example 1 in which the opening number of the air intake holes 9 is two was seen in the air inflow ratio Rpod of the example 9 in which four air intake holes 9 are disposed at positions shifted from each other by 90° in the circumferential direction about the center axis CL of the smoking device.

Here, compared the air inflow ratio Rpod between the example 1 and the example 10 that differ from each other only in the opening number of the air intake holes 9, a result in which the air inflow ratio Rpod was higher in the example 10 (Rpod: 12.4%) in which the number of the air intake holes 9 is one than in the example 1 (Rpod: 0.15%) in which the number of the air intake holes 9 is two was obtained. This is considered to be caused by a factor in which, in the example 10 in which the number of the air intake holes 9 is one, the linear velocity of the air that flows into the chamber section 8 from outside through the air intake hole 9 during suction (puffs) is higher than in the example 1 in which the number of the air intake holes 9 is two and a factor in which, in the example 10 in which the number of the air intake holes 9 is one, collision of the air that has flowed in from the air intake hole 9 against the inner wall surface of the chamber section 8 that faces the air intake hole 9 easily causes an air flow in a downward direction, that is, in the direction of the flavor source accommodation pod 3. The linear velocity of the air that flows into the chamber section 8 from the outside through the air intake holes 9 during suction (puffs) was 146.2 m/second in the example 1 and 257.9 m/second in the example 10. According to the above, it can be said that, preferably, a plurality of the air intake holes 9 are disposed in the chamber section 8 in the examples employing the heated-section non-ventilation structure.

When the opening diameter (diameter) of each air intake hole 9 was varied, the linear velocity of the intake air in the example 11 in which the opening diameter is 0.2 mm was approximately eight times with respect to that in the example 12 in which the opening diameter is 0.8 mm. It was confirmed that, although the air inflow ratio Rpod in the example 11 was increased as a result of the air flow in the direction of the flavor source accommodation pod 3 being remarkably formed, the influence of the opening diameter was small because the Rpod itself was 1% or less.

According to the aforementioned verification results, each of the examples employing the heated-section non-ventilation structure in which the air intake holes 9 are disposed in the chamber section 8 that is disposed at the rear stage in the direction of the flavor source accommodation pod 3 can be considered to have, when the air inflow ratio Rpod is 25% or less, the feature of the heated-section non-ventilation structure sufficiently. More preferably, the air inflow ratio Rpod is 15% or less, and, further preferably, the air inflow ratio Rpod is 1% or less. The capacity of the chamber section 8 (the total of the capacities of the first chamber section 8A and the second chamber section 8B) is preferably 2.1 mL or more and is more preferably 7.9 mL or more. The higher the opening position, in other words, the higher the opening height ratio (the ratio of the length from the vapor discharge port 31*c* to the air intake holes 9 with respect to the length from the vapor discharge port 31*c* to the suction port hole 200) of the air intake holes 9, the more preferable as the height at which the air intake holes 9 are disposed in the chamber section 8. It is preferable that the opening height ratio of the air intake holes 9 be set to 63% or higher. Considering use as a smoking tool, installation of a mouthpiece having a length that enables a person to hold the mouthpiece between the lips is essential, and, if the air intake holes 9 are disposed at positions to be included in the oral cavity, inflow of air is disabled. Therefore, a proper range of the opening height ratio of the air intake holes 9 is considered to be 90% or less. Regarding the opening diameter (diameter) of each air intake hole 9, 0.2 mm or more and 0.8 mm or less can be presented as a preferable range.

As indicated in FIG. 10, the smoke temperature in the comparative example 1 is over 100° C. while the smoke temperature in each of the examples 1 to 12 is maintained to be 60° C. or less. Setting the temperature of a vapor component of the flavor source 32 during smoke suction to be 60° C. or less, as above, enables supply of aerosol having a temperature in a range in which smoking is easy for a smoker.

Figure 17:
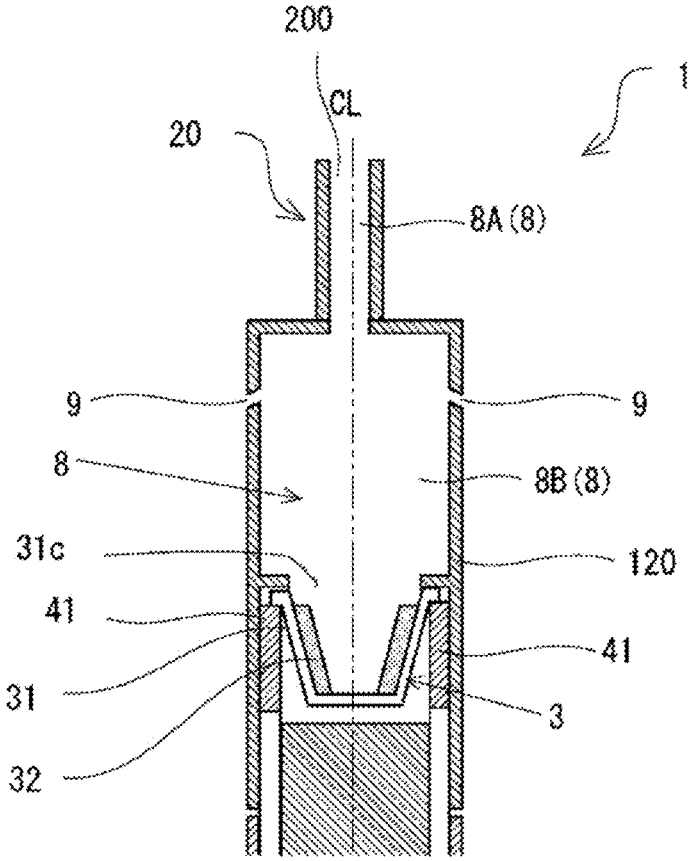
FIG. 17 describes an air intake hole of a non-combustion heating-type smoking article according to a modification.

The air intake holes 9 of the non-combustion heating-type smoking article 1 in the present embodiment are disposed in a direction in which the flowing direction (the axial direction of the air intake holes 9) when air flows into the chamber section 8 is orthogonal to the center axis CL. The air intake holes 9, however, may be inclined with respect to the center axis CL such that the flowing direction (the axial direction of the air intake holes 9) when air flows into the chamber section 8 is directed to the side of the suction port hole 200 of the mouthpiece 20, as with the modification illustrated in FIG. 17. Consequently, the intake air that has flowed into the chamber section 8 from the air intake holes 9 is further suppressed from easily entering the flavor source accommodation pod 3. Therefore, it is possible to more suitably realize suppression of the rise of the smoke temperature and stable supply of the flavor component.

REFERENCE SIGNS LIST

1 non-combustion heating-type smoking article
2 power source section
3 flavor source accommodation pod
4 heater
5 electronic control section
6 power switch
7 hollow section
8 chamber section
9 air intake hole
20 mouthpiece
31 heat-resistant container
32 flavor source
41 heating element
100 casing
200 suction port hole

What is claimed is:

1. A non-combustion heating-type smoking article comprising:

a mouthpiece having a suction port hole;

a flavor source accommodation section that accommodates a flavor source and that has a vapor discharge port through which a vapor component generated by evaporation of the flavor source is discharged;

a heater for heating and evaporating the flavor source;

a chamber section for establishing communication between the vapor discharge port and the suction port hole and temporarily storing the vapor component generated by the evaporation of the flavor source; and an air intake hole that establishes communication between an inside and an outside of the chamber section, wherein the vapor discharge port is opened to only the chamber section, the vapor component that has accumulated in the chamber section is mixed during suction with intake air that has flowed into the chamber section from the air intake hole, and the vapor component is transported to the suction port hole, wherein the flavor source accommodation section is a container having a cup shape and the vapor discharge port is formed as an open end of the container, wherein the heater includes a heating element that heats a side surface of the flavor source accommodation section, and wherein the flavor source is adhered to an inner side of the side surface of the flavor source accommodation section.

2. The non-combustion heating-type smoking article according to claim 1, wherein an amount of air that flows into the flavor source accommodation section from the air intake hole through the chamber section is 25% or less with respect to a total amount of air that flows in from the air intake hole.

3. The non-combustion heating-type smoking article according to claim 1, wherein the flavor source includes shredded tobacco and an aerosol-source material.

4. The non-combustion heating-type smoking article according to claim 1, comprising:

a power source section that supplies power to the heater, wherein the power source section supplies the power to the heater constantly throughout an energization period from when a predetermined energization start condition is established until when a predetermined energization termination condition is established.

5. The non-combustion heating-type smoking article according to claim 1, wherein a capacity of the chamber section is 2.1 mL or more and 20 mL or less.

6. The non-combustion heating-type smoking article according to claim 1, wherein a capacity of the chamber section is 7.9 mL or more and 20 mL or less, and a ratio of a length from the vapor discharge port to the air intake hole with respect to a length from the vapor discharge port to the suction port hole is 63% or more and 90% or less.

7. The non-combustion heating-type smoking article according to claim 1, wherein a cooling member for cooling the vapor component of the flavor source is not disposed in the chamber section.

8. The non-combustion heating-type smoking article according to claim 1, wherein a diameter of the air intake hole is 0.2 mm or more and 0.8 mm or less.

9. The non-combustion heating-type smoking article according to claim 1, wherein a plurality of the air intake holes are disposed in the chamber section.

* * * * *